US009030363B2

(12) United States Patent
Kenington et al.

(10) Patent No.: US 9,030,363 B2
(45) Date of Patent: May 12, 2015

(54) METHOD AND APPARATUS FOR TILTING BEAMS IN A MOBILE COMMUNICATIONS NETWORK

(75) Inventors: Peter Kenington, Chepstow (GB); Martin Weckerle, Ulm (DE); Dirk Neumann, Ulm (DE); Kevin E Linehan, Rowlett, TX (US)

(73) Assignee: Kathrein-Werke AG, Rosenheim (DE)

( * ) Notice: Subject to any disclaimer, the term of this patent is extended or adjusted under 35 U.S.C. 154(b) by 825 days.

(21) Appl. No.: 12/648,809

(22) Filed: Dec. 29, 2009

(65) Prior Publication Data

US 2011/0156974 A1 Jun. 30, 2011

(51) Int. Cl.
*H01Q 3/00* (2006.01)
*H01Q 1/24* (2006.01)
*H01Q 25/00* (2006.01)

(52) U.S. Cl.
CPC ..... *H01Q 1/246* (2013.01); *H01Q 25/00* (2013.01)

(58) Field of Classification Search
CPC ..... H01Q 1/246; H01Q 25/00
USPC ..... 343/757, 763, 766
See application file for complete search history.

(56) References Cited

U.S. PATENT DOCUMENTS

| | | | | |
|---|---|---|---|---|
| 4,424,500 | A | 1/1984 | Viola et al. | |
| 4,638,317 | A | 1/1987 | Evans | |
| 5,461,389 | A | 10/1995 | Dean | |
| 5,675,629 | A | 10/1997 | Raffel et al. | |
| 5,812,088 | A | 9/1998 | Pi et al. | |
| 6,067,054 | A * | 5/2000 | Johannisson et al. | 343/816 |
| 6,081,233 | A | 6/2000 | Johannisson | |
| 6,094,165 | A | 7/2000 | Smith | |
| 6,282,434 | B1 | 8/2001 | Johannisson et al. | |
| 6,442,371 | B1 | 8/2002 | Lyu | |
| 6,640,110 | B1 | 10/2003 | Shapira et al. | |
| 6,785,559 | B1 | 8/2004 | Goldberg et al. | |
| 7,043,270 | B2 | 5/2006 | Judd et al. | |
| 7,069,053 | B2 | 6/2006 | Johannisson et al. | |
| 7,236,131 | B2 | 6/2007 | Fager et al. | |
| 7,236,807 | B1 | 6/2007 | Shapira et al. | |
| 7,409,901 | B2 | 10/2008 | Needham et al. | |
| 7,583,982 | B2 | 9/2009 | Olesen et al. | |
| 8,064,958 | B2 | 11/2011 | Skarby et al. | |
| 8,208,962 | B2 | 6/2012 | Thomas | |
| 8,228,840 | B2 | 7/2012 | Skarby | |
| 8,320,825 | B2 | 11/2012 | Goransson et al. | |

(Continued)

FOREIGN PATENT DOCUMENTS

WO 99/17576 4/1999

OTHER PUBLICATIONS

U.S. Appl. No. 12/563,693, entitled: Antenna Array, Network Planning System, Communication Network and Method for Relaying Radio Signals With Independently Configurable Beam Pattern Shapes Using a Local Knowledge, Sep. 21, 2009.

*Primary Examiner* — Robert Karacsony
(74) *Attorney, Agent, or Firm* — Stephen H. Eland; Dann, Dorfman, Herrell & Skillman

(57) ABSTRACT

An antenna array for a mobile communications network is disclosed which comprise mechanical devices for altering a direction of a first beam and electronic beam forming apparatus for shaping a second beam. A method for tilting radio beams in a mobile communications network using the antenna array is also disclosed. The method comprises mechanical tilting a first protocol radio beam and electronic tilting a second protocol radio beam.

17 Claims, 7 Drawing Sheets

(56) References Cited

U.S. PATENT DOCUMENTS

| | | | | |
|---|---|---|---|---|
| 2004/0204109 | A1 | 10/2004 | Hoppenstein | |
| 2007/0030208 | A1* | 2/2007 | Linehan | 343/757 |
| 2008/0225775 | A1 | 9/2008 | Proctor et al. | |
| 2008/0254845 | A1 | 10/2008 | Chang et al. | |
| 2008/0318632 | A1 | 12/2008 | Rofougaran et al. | |
| 2009/0181722 | A1 | 7/2009 | Stensson | |
| 2010/0117913 | A1 | 5/2010 | Jung | |

* cited by examiner

METHOD AND APPARATUS FOR TILTING BEAMS IN A MOBILE COMMUNICATIONS NETWORK

CROSS REFERENCE TO OTHER APPLICATIONS

The present application is related to U.S. patent application Ser. No. 12/648,773 entitled "Active Antenna Array and Method for relaying first and second Protocol Radio Signals in a Mobile Communications Network" filed Dec. 29, 2009, which is incorporated in its entirety. The present application is further related to U.S. patent application Ser. No. 12/648,852 entitled "Active Antenna Array for a Mobile Communications Network with Multiple Amplifiers Using Separate Polarisations for Transmission and a Combination of Polarisations for Reception of Separate Protocol Signals" filed Dec. 29, 2009, which is incorporated in its entirety. The present application is further related to U.S. patent application Ser. No. 12/648,713 entitled "Active Antenna Array with Multiple Amplifiers for a Mobile Communications Network and Method of Providing DC Voltage to at least one Processing Element" filed Dec. 29, 2009, which is incorporated in its entirety. This application is further related to commonly-assigned U.S. patent application Ser. No. 12/563,693 entitled "Antenna Array, Network Planning System, Communication Network and Method for Relaying Radio Signals with Independently Configurable Beam Pattern Shapes Using a local Knowledge" filed Sep. 21, 2009, which is incorporated herein in its entirety.

FIELD OF THE INVENTION

The field of the present invention relates to a method and system to provide tilting abilities in mobile communications antennas.

BACKGROUND OF THE INVENTION

Mobile communications network infrastructure has evolved massively over the last decade, with major developments having been introduced to cater for changes in frequencies, technologies, speeds, and coverage. An issue that is addressed is the efficiency of the mobile communications network infrastructure in order to optimize the return on investment.

One possible solution would be to provide antennas that can concurrently service a plurality of radio signals using different air interface protocols or standards, such as GSM, UMTS and future LTE standards. One issue that to be addressed in the design of such antennas is the difference in tilt angles of the beams of the radio signal that are required for the different standards, to provide for differing coverage footprints when networks based on such different standards are deployed.

PRIOR ART

One known solution could be to implement a joint GSM900/UMTS900 site by utilizing separate GSM and UMTS base stations and to combine the radio signals to and from the different base stations by using a filter-combiner or a passive combiner. This solution, however, is inflexible.

FIG. 1 shows a prior art solution for sharing an antenna system for two different air interface standards (e.g. for the GSM standard and the UMTS standard in the 900 MHz band). The antenna system is entirely passive. A feeder cable 10 between the base station and the antenna incorporates a tower mounted amplifier 20 (TMA) typically mounted on a masthead to improve the noise figure (sensitivity) of the received radio signals in both of the GSM standard and the UMTS standard. A diplexer 40 allows transmit signals from a first base station 30 (e.g. a GSM900 base station) and a second base station 35 (e.g. a UMTS base station) to combine with a low combiner loss. The antenna elements Ant-1, Ant-2, . . . , Ant-16 are connected to the TMA 20 by a second feeder cable 15 through a corporate feed network 60. Power to the TMA 20 is provided from a power source 50 through a coupler 55, making use also of the feeder cable 10.

The diplexer 40 requires a roll-off band between the two different air interface standards. This is, in effect, wasted spectrum, since the roll-off band is within the allocation of both of the different air interface standards making this prior art solution an expensive (in terms of spectrum license fees) and inflexible solution (as the relative portions of the band dedicated to the GSM standard and the UMTS standard are fixed).

In a prior art passive antenna system, antenna beam down-tilting can be achieved using either mechanical tilting (e.g. using a stepper-motor or servo-motor based system for remotely moving the passive antenna's system tilt angle, by physically moving the whole of the antenna itself) or by using a 'remote electrical tilt' (RET) system. This RET system typically utilizes motor-controlled phase shift elements to achieve a tilt of the beam formed from the radio signals.

In the case of the purely mechanical tilting, the tilt angle of the antenna system 60 is controlled from a remote (or sometimes centralized) location, with the tilt angle being set by an operator and the antenna system's tilting motors responding and physically increasing or decreasing the tilt angle. This technique is commonly used on older antenna systems, such as those at 900 MHz GSM sites. If this type of antenna was used to transmit both the GSM radio signals and the UMTS radio signals (as shown in FIG. 1), then both the radio signals using the GSM standard and the radio signals using the UMTS standard would experience substantially identical tilt angles. This is generally considered to be undesirable, since the characteristics of these two different air interface standards are very different (e.g. modulation format, data rate, primary application etc.) and most operators would like to be able to set independent tilt angles for each of the different air interface standards, thereby tailoring the coverage and quality of service provided according to the system.

The use of electronic tilting is known, for example, from U.S. Pat. No. 6,282,434 (Johannisson et al., assigned to Ericsson). Which teaches an apparatus and a method for reducing co-channel interference between cells by adjusting the orientation or tilt angle of the base station antenna. The patent notes that by redirecting the antenna so that the antenna beam points further and further below the horizon, the energy associated with the antenna beam is to a grater extent, directed into the target cell and away from any adjacent cells in close proximity to the target cell. The patent further notes that tilting of the antenna beam can be achieved either mechanically or electrically.

BRIEF SUMMARY OF THE INVENTION

There is a need for an antenna system and method with the ability to service a plurality of air interface standards.

An antenna array for a mobile communications network is disclosed. The antenna array comprises mechanical devices for altering a direction of a first beam and an electronic beam forming apparatus for shaping a second beam. This device allows two different angles of tilt for two different types of radio signals to be generated.

A method for tilting radio beams in a mobile communications network using an antenna array is also disclosed. This method comprises a mechanical tilting of a first protocol radio beam and substantially concurrently, previously or subsequently, an electronic tilting of a second protocol radio beam. The method also comprises the utilization of the electronic tilting to compensate for the mechanical tilting of the antenna array and thereby provide the illusion, to the system operator, of having entirely independent tilting for the first protocol radio beam and the second protocol radio beam.

It will be appreciated that although the disclosure describes the use of the antenna array for the two different types of protocols, it will be possible for the two protocols to be identical.

DETAILED DESCRIPTION OF THE INVENTION

For a better understanding of the present disclosure reference shall now be made to the preferred aspects of the present disclosure, examples of which are illustrated in the accompanying drawings.

It shall further be understood that the drawings are not to be construed in a limiting way. The scope of protection is defined by the claims as part of this application. For a person skilled in the art it is obvious that several aspects of the following description may as well be combined.

Figure 2:
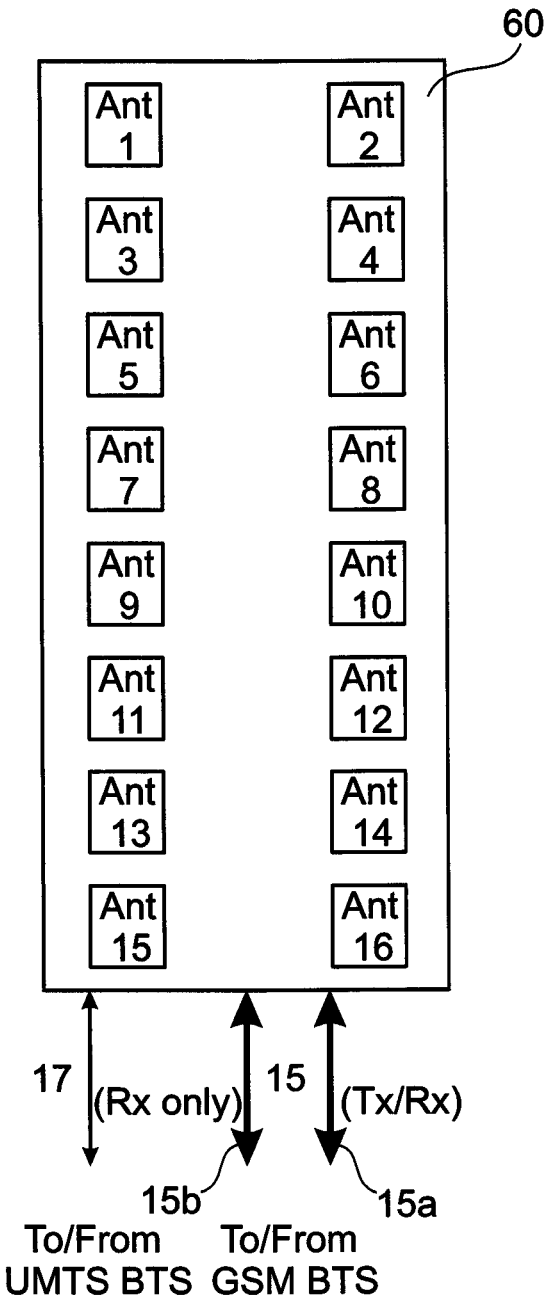
FIG. 2 shows an outline of an active/passive antenna array.

FIG. 2 shows an outline of an active/passive antenna system allowing an existing first base station 30, using the GSM standard (for example), to be utilized with an antenna-embedded radio system for the UMTS standard (for example). The antenna system 60 of FIG. 2 has three feeds 15*a*, 15*b* and 17 to incorporate diversity for both of the different air interface standards. A first feed 15*a* is a traditional coaxial feed 10 which transports high-power transmit and low-power receive signals to and from the antenna system 60. The second feed 15*b* is also a traditional coaxial feed. In this case the second feed 15*b* is for the diversity receive signals only. The third feed 17 is a digital feed, for example using a fiber-optic cable, which carries UMTS signals in, for example, an OBSAI, CPRI or P-OBRI format (including both diversity channels). This third feed 17 is used to transport the UMTS signals to and from the active circuits within an antenna-embedded radio.

Figure 3:
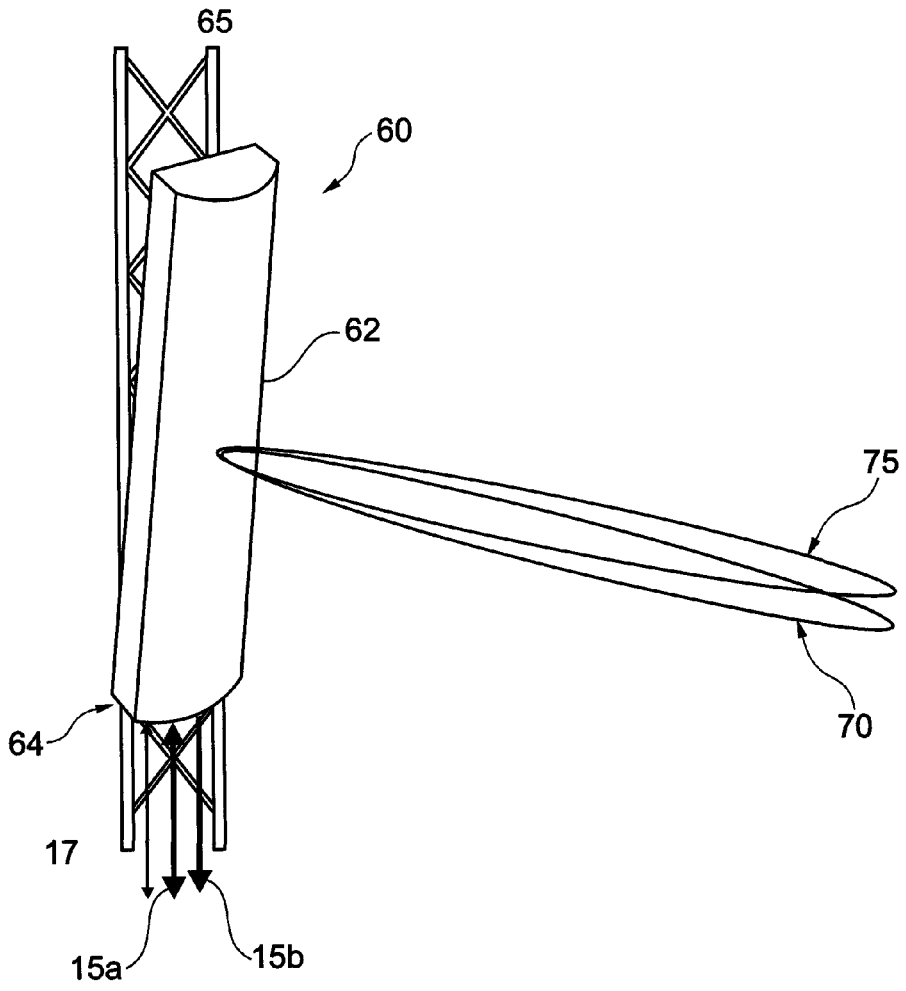
FIG. 3 shows the combined use of both mechanical antenna tilting and electronic tilting.

FIG. 3 shows a combined use of both a mechanical antenna tilting and an electronic tilting to provide independent tilt angles for both of the GSM radio signals 70 and the UMTS radio signal 75. Note that FIG. 3 illustrates the tilting of an entire antenna system, including its housing 62. In most implementations, however, the internal board/hardware/antenna 62 elements of the antenna system 60 only are tilted. This tilting is generally done using an actuator 64 mounted beneath the antenna housing 62 and rotating a rod (not shown) that passes into the antenna housing 62, driving gearing to generate the tilting. The antenna housing 62 of the antenna system 60 remains fixed. This is possible since the tilt adjustment range of most antenna systems 60 is modest (typically <20 degrees).

Figure 1:
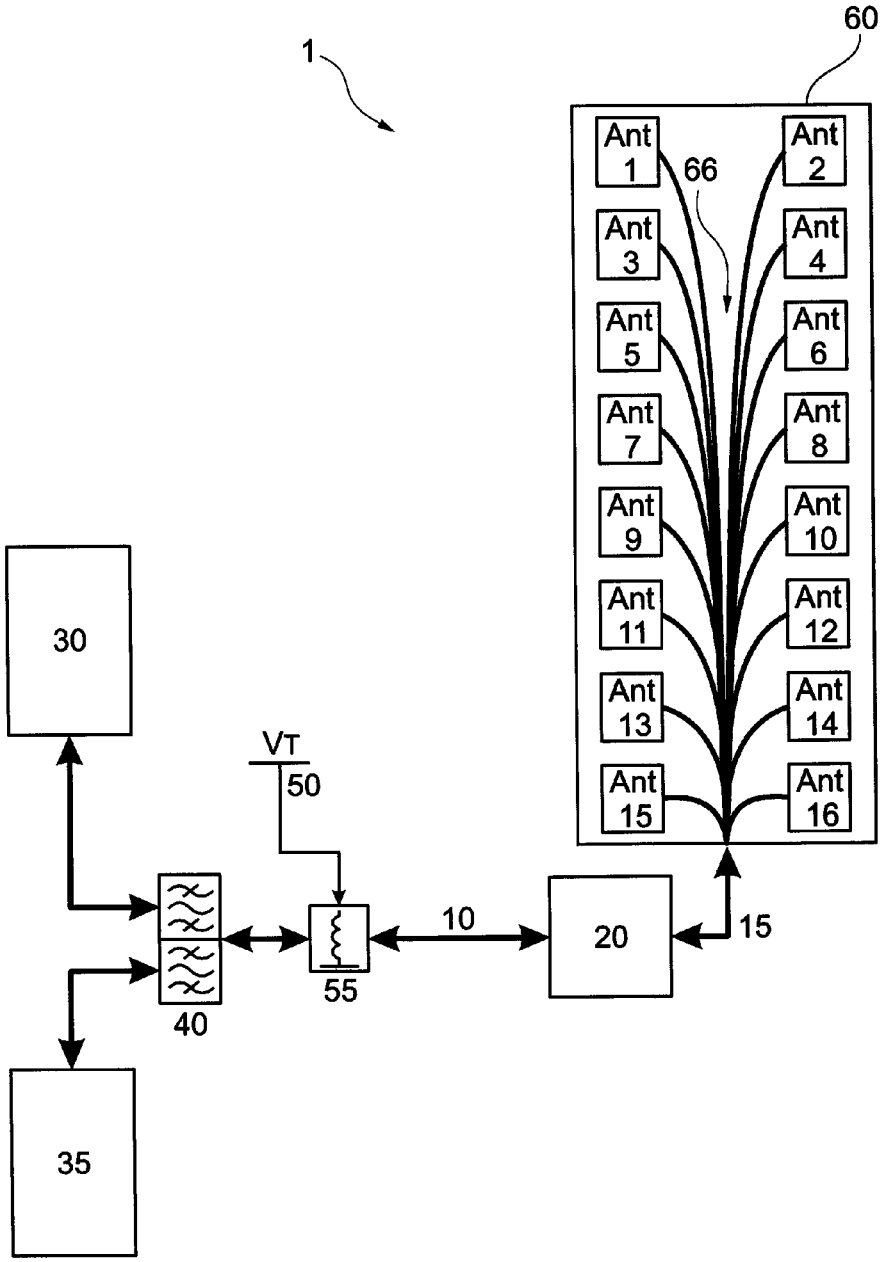
Fig. 1 Prior Art
FIG. 1 shows a prior art method of sharing the same antenna array, for two different air interface standards.

Looking at the GSM radio signals first. The GSM radio signals are transported on the high-power coaxial first feeder cable 15 to and from the GSM first base station 30. Once these GSM radio signals reach the antenna system 60 they are distributed by the corporate feed network 66 (see FIG. 1) in the same manner as in a conventional antenna system. These are termed "passive signals" since their phase and amplitude is fixed by the corporate feed network 66 and cannot be varied dynamically.

Figure 4:
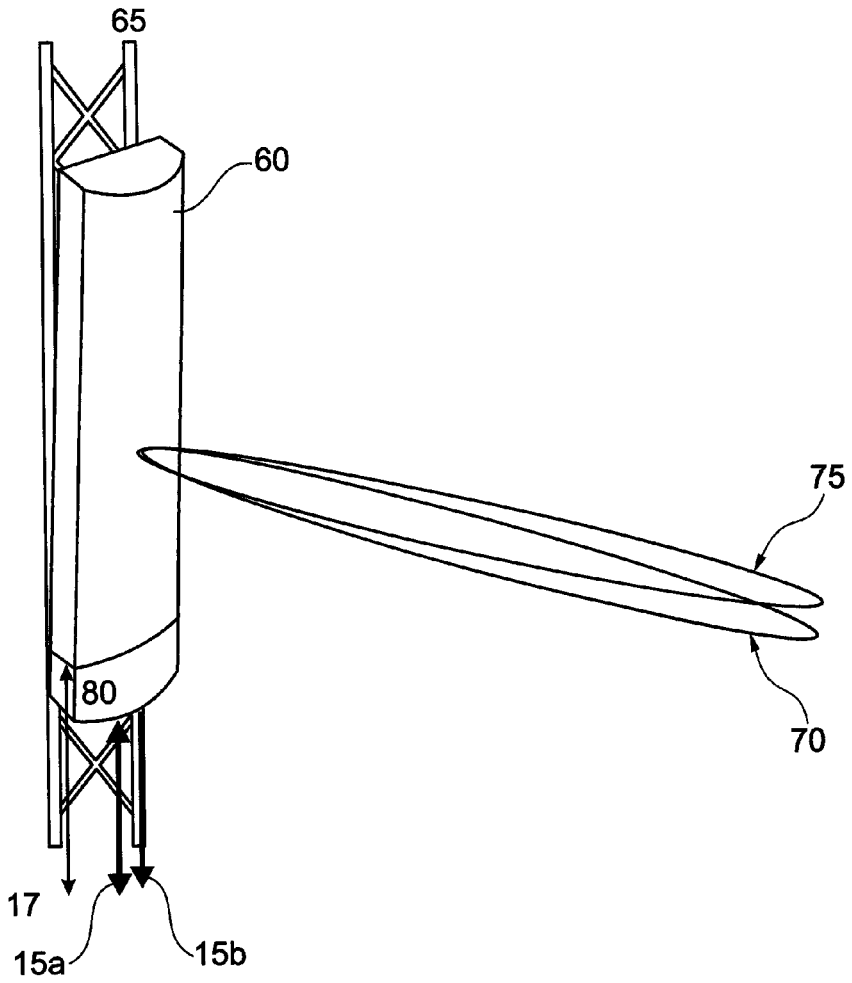
FIG. 4 shows a combined passive/active antenna array.

FIG. 4 shows a further aspect of combined passive/active antenna system 60. The passive system (e.g. the GSM system) is fed by one or more coaxial feeder cables 15*a*; 15*b* and the active system (e.g. UMTS) is fed by the fiber-optic cable (or other high-speed data link) as the third feed 17. The passive system's transmit and receive radio signals are distributed to the antenna elements (Ant1, . . . . Ant-N) by means of the corporate feed network 66 and combined with the output of the active electronics at, or close to, the antenna elements (Ant1, . . . Ant-N) themselves. The intrinsic downtilt of the passive signals is determined by the design of the corporate feed network 66 and is fixed by the design. An additional downtilt is achieved by mechanical movement of the antenna system 60, as described above.

In the case of the active radio signals, these active radio signals are received from the fiber optic cable 17 in a digital form (e.g. CPRI, OBSAI or P-OBRI format, as noted above) and undergo digital processing (e.g. beamforming, crest-factor reduction, digital upconversion/downconversion, etc.) prior to digital to analogue conversion (or vice-versa), further upconversion/downconversion (if needed) and power or low-noise amplification. The beamforming operation takes place electronically, as a mathematical operation on the digital signals, prior to their conversion to analogue signals (in the transmit direction) or following their conversion to digital signals (in the receive direction) and involves altering amplitude, delay and/or phase of the active radio signals. These beamforming operations can occur independently for both of the transmit signals and the receive signals, thereby allowing the tilt angle of the antenna system 60 to be different for its UMTS (for example) uplink signals and downlink signals. The beamforming operations performed on the active radio signals are also independent of the mechanical tilt of the antenna system 60, thereby allowing the tilt angle of the passive signals (e.g. GSM) to be decoupled from that of the active signals (e.g. UMTS). It is even possible to provide an uptilt of the active signals, if it is desired to have a smaller tilt angle (but still downward) for the active signals than the tilt angle set mechanically for the passive signals. This is the situation illustrated in FIG. 3.

Since the actuator 64 for the mechanical tilt system physically moves the antenna system 60 itself, changes to the tilt angle of the beam formed from the passive radio signals will necessitate compensatory changes being made in the downtilt of the beam formed from the active radio signals, assuming that the original coverage pattern of the active radio signals needs to be maintained, unchanged. These changes would be automated, with the operation of the tilts appearing to be entirely independent, as far as the operator was concerned.

FIG. 4 shows a similar arrangement to that of FIG. 3. In the case of FIG. 4*a* a remote electrical tilt unit 80 is employed in place of the mechanical tilt used in FIG. 3. In a RET installation, the antenna system 60 is mounted at a fixed angle to the mast 65 (typically at a small downtilt angle, as shown), with the main component of the downtilt being provided by a combination of the settings in the RET unit 80 at the bottom of the antenna system 60 and the design of the corporate feed network 66. It will be recalled that the design of the corporate feed network 66 is fixed. The RET unit 80 contains a number of mechanically-variable phase shifters (and/or attenuators) which are used to modify the incoming and outgoing passive GSM radio signals to the antenna system 60. These mechanically-variable phase shifters are coupled to stepper motors or servo motors by which means they can be remotely set and adjusted in a similar manner to that of the actuator 64 for the mechanical tilt mechanism discussed above (i.e. by an operator at a remote location). These mechanically-variable phase shifters allow the tilt angle experienced by the passive GSM radio signals to be varied as in a prior art passive antenna system.

Likewise, the UMTS radio signals are processed in the active part of the antenna system 60 and undergo electronic beam-forming/shaping/steering/tilting independently of the GSM RET tilt system. This allows the tilt of both the passive (GSM) system and the active (UMTS) system to be undertaken independently of one another. In the case of the RET unit 80, however, changes to the tilt angle of the passive GSM system will not necessitate compensatory changes to the tilt angle of the active system, since the antenna system itself does not physically move in this case.

Figure 5:
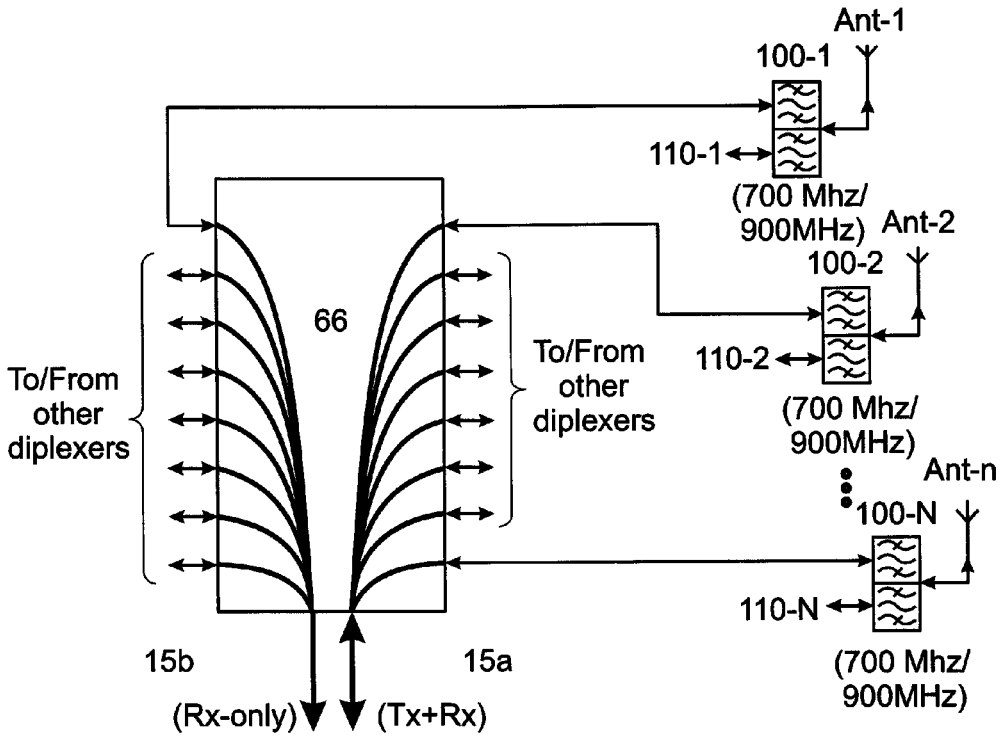
FIG. 5 shows a combined passive/active antenna array accepting radio signals in different bands.

FIG. 5 shows a further aspect of the invention for a dual band operation of the antenna system 60. In the aspect shown in FIG. 5 it is possible for radio signals at, for example, 700 MHz and 900 MHz to share a single one of the antenna elements Ant-1 . . . Ant-2, . . . , Ant-n. Diplexers 100-1, 100-2, . . . , 100-N are used to feed the 700 MHz radio signals and the 900 MHz radio signals to each one of the antenna elements Ant-1, Ant-2, . . . , Ant-n. The diplexers 100-1, 100-2, 100-N are small, have a low power and are relatively low performance use units. They can be ceramic or surface acoustic wave devices with the ability to handle only a few watts power. The relatively low-performance required from the diplexers 100-1, 100-2, . . . 100-N results from the fact that there is a large frequency separation between the 700 MHz frequency beam and the 900 MHz frequency beam. Hence the requirement for roll-off rates in filters can be relaxed. Design efforts can be used to reduce of the through-loss of the radio signals in the 700 MHz band and the 900 MHz band.

Figure 6:
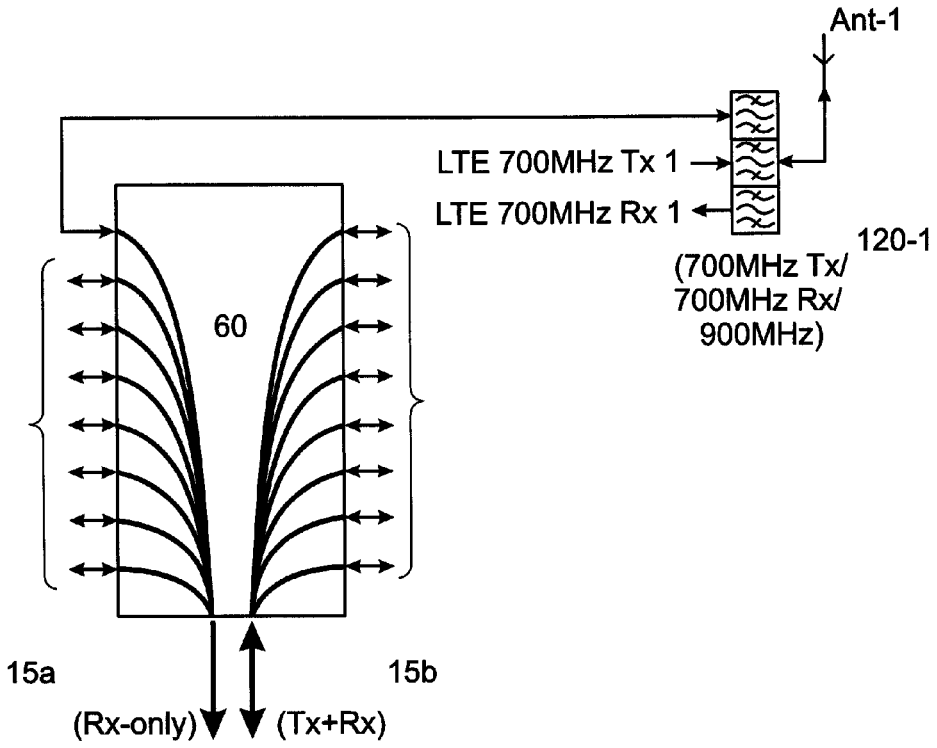
FIG. 6 shows a further aspect of a combine passive/active antenna array using triplexers.

FIG. 6 shows a further aspect of the invention in which the diplexers 100-1, 100-2, . . . , 100-N are replaced by triplexes 120 which are fed by a 700 MHz radio transmission signal and also receive a 700 MHz radio receive signal. This is useful when using the LTE standard, for example.

Figure 7:
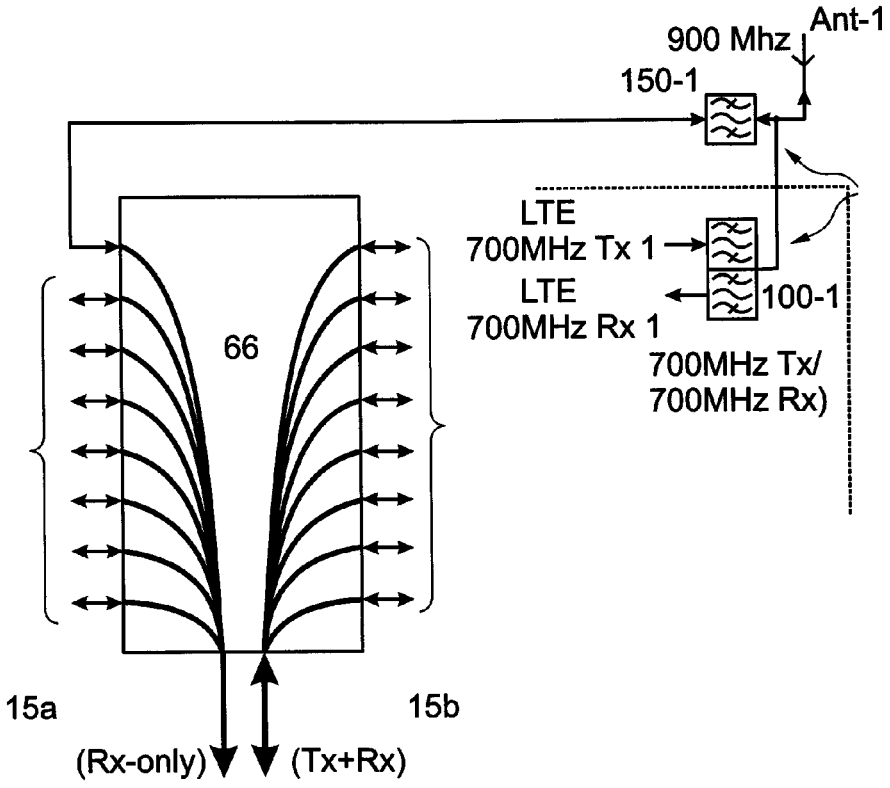
FIG. 7 shows a variation of a combined passive/active antenna array using diplexers.

A further aspect of the invention is shown in FIG. 7 in which the diplexers 100-1, 100-2, . . . 100-N or the triplexes 120-1 of FIG. 6 are replaced by a band pass filter 150-1 which filters off the passive 900 MHz radio signals and a third diplexer 160-1 which is also connected to the antenna element Ant-1. The further diplexer 160-1 receives LTE radio signals at 700 MHz for passage to a base station (not shown) and also transmits LTE 700 MHz radio signals.

It will be understood that the aspects shown in FIGS. 6 and 7 only show the connection to one of the antenna elements, in this example Ant-1, and not to all of the antenna elements in the antenna array 60. It will be appreciated that the person skilled in the art would be able to modify and adapt the aspect shown in these figures so that the connection is made to all of the required ones of the antenna elements.

Accordingly, with the present invention, a method and system is provided with the ability to have different downtilt angles for different standards (e.g. for GSM and UMTS at 900 MHz or GSM at 800/900 MHz and LTE at 700 MHz) whilst maintaining the efficiency and flexibility benefits of the use of an antenna-embedded radio system (for a newer radio protocol) and also the ability to utilize legacy base-station systems and hardware for older (existing) radio protocols.

While various embodiments of the present invention have been described above, it should be understood that they have been presented by way of example, and not limitation. It will be apparent to persons skilled in the relevant arts that various changes in form and detail can be made therein without departing from the scope of the invention.

The invention claimed is:

1. An antenna array for a mobile communications network comprising:

at least one mechanical device for altering a direction of at least one antenna array element for transceiving a first radio beam of first protocol passive radio signals; and an electronic beam forming apparatus of the antenna array element for shaping independently a second radio beam of second protocol active radio signals; and a protocol processing network adapted to electronically process the second protocol active radio signals.

2. The antenna array according to claim 1, wherein the at least one mechanical device comprises at least one of an actuator, an amplitude shifter or a phase shifter.

3. The antenna array of claim 1, further comprising a corporate feed network adapted to fixedly alter at least one of an amplitude, a phase and a delay of first signal components of the first radio beam of first protocol passive radio signals.

4. The antenna array of claim 1, further comprising:

at least one first divider connected between antenna array elements, a first protocol processing network and the second protocol processing network, the at least one divider relaying first signal components of the first radio beam of first protocol passive radio signals to the first protocol processing network and relaying second signal components of the second radio beam of second protocol active radio signals to the second protocol processing network.

5. The antenna array of claim 4, wherein the first protocol processing network is adapted to alter fixedly one of an amplitude, a phase or a delay of the first signal components.

6. The antenna array of claim 4, further comprising at least one second divider adapted to separate received signal components of the second protocol active radio signals and transmitted signal components of the second protocol active radio signals.

7. A method for tilting radio beams in a mobile communications network using an antenna array comprising:

mechanical tilting of at least one antenna array element transceiving a first radio beam of first protocol passive radio signals; and independently electronic beam forming of a second radio beam of second protocol active radio signals within the at least one antenna array element; and electronically processing the second protocol active radio signals by a protocol processing network.

8. The method of claim 7, wherein the mechanical tilting comprises altering at least one of a phase of first signal components of the first beam of first protocol passive radio signals.

9. The method of claim 7, wherein the mechanical tilting comprises altering a tilt angle of at least one antenna array element.

10. The method of claim 7, wherein the electronic beam forming comprises altering at least one of an amplitude, a delay or a phase of at least one second signal component of the second protocol active radio signals.

11. The method of claim 7, wherein the electronic tilting is carried out in the digital domain.

12. The method of claim 7, wherein the electronic beam forming is performed by mathematical operations on a plurality of the signal components of the second radio beam of the second protocol active radio signals.

13. A computer program product comprising a non-transitory computer-usable medium having control logic stored therein for causing a computer to execute instructions that enable a processor to carry out a method for tilting radio beams in a mobile communications network using an antenna array wherein the method comprises:

mechanical tilting of at least one antenna array element transceiving a first radio beam of first protocol passive radio signals; and independently electronic beam forming of a second radio beam of the second protocol active radio signals within the at least one antenna array element electronically processing the second protocol active radio signals.

14. The antenna array according to claim 1, wherein at least one mechanical device alters the direction of the antenna array comprising at least two antenna array elements.

15. The antenna array according to claim 1, wherein the antenna array element for sending the first radio beam of the first protocol passive radio signals is different compared to the antenna array element for shaping the second radio beam of the second protocol active radio signals.

16. The antenna array of claim 1, wherein the shaping of the second radio beam of second protocol active radio signals is performed in the digital domain.

17. The method of claim 8, wherein the electronic beam forming of the second radio beam is carried out in the digital domain.

* * * * *

UNITED STATES PATENT AND TRADEMARK OFFICE

CERTIFICATE OF CORRECTION

PATENT NO. : 9,030,363 B2
APPLICATION NO. : 12/648809
DATED : May 12, 2015
INVENTOR(S) : Peter Kenington et al.

It is certified that error appears in the above-identified patent and that said Letters Patent is hereby corrected as shown below:

In the Claims

Claim 13, line 12, "one antenna array element electronically processing"

should read -- one antenna array element by electronically processing --;

Claim 17, line 1, "The method of claim 8,"

should read -- The method of claim 7, --.

Signed and Sealed this
Twenty-ninth Day of September, 2015

Michelle K. Lee

Michelle K. Lee
*Director of the United States Patent and Trademark Office*